United States Patent [19]

Dankowski et al.

[11] Patent Number: 4,790,949

[45] Date of Patent: Dec. 13, 1988

[54] AQUEOUS BLEACHING AGENT SUSPENSIONS CONTAINING PEROXYCARBOXYLIC ACID, METHOD FOR THEIR PREPARATION AND USE

[75] Inventors: Manfred Dankowski, Mömbris; Thomas Lieser; Günter Prescher, both of Hanau; Wolfgang Leonhardt, Frankfurt, all of Fed. Rep. of Germany

[73] Assignee: Degussa Aktiengesellschaft, Frankfurt, Fed. Rep. of Germany

[21] Appl. No.: 168,996

[22] Filed: Mar. 16, 1988

[30] Foreign Application Priority Data

Mar. 21, 1987 [DE] Fed. Rep. of Germany ..... 3709347

[51] Int. Cl.[4] ..... C11D 3/39; C11D 7/20; C11D 7/38; D06L 3/02

[52] U.S. Cl. ..... 252/95; 252/99; 252/100; 252/102; 252/174.25; 252/186.26; 252/186.42; 252/311; 252/313.2; 252/DIG. 14

[58] Field of Search ..... 252/186.26, 186.42, 252/95, 100, 102, 99, 174.25, 311, 313.2

[56] References Cited

U.S. PATENT DOCUMENTS

| | | | |
|---|---|---|---|
| 3,996,152 | 12/1976 | Edwards | 252/186 |
| 4,017,412 | 4/1977 | Bradley | 252/186 |
| 4,642,198 | 2/1987 | Humphreys | 252/94 |
| 4,738,794 | 4/1988 | Harrison | 252/186.26 |

FOREIGN PATENT DOCUMENTS

| | | |
|---|---|---|
| 0160342 | 11/1985 | European Pat. Off. . |
| 0176124 | 4/1986 | European Pat. Off. . |
| 1535804 | 12/1978 | United Kingdom . |
| 2188654A | 10/1987 | United Kingdom . |

*Primary Examiner*—Dennis Albrecht
*Attorney, Agent, or Firm*—Cushman, Darby & Cushman

[57] ABSTRACT

Aqueous bleaching agent suspensions based on a water-insoluble peroxycarboxylic acid suspended in a carrier liquid in the presence of a colloidal silicic acid and of an acidifying agent which exhibit, in comparision to known suspensions with this base, an improved storage resistance and are more economical to prepare. This result is achieved by means of pourable-to-pasty bleaching agent suspensions which contain 0.1 to 9% by weight silicic acid in relation to the suspension and contain a hydrate-forming neutral salt which desensitizes peroxycarboxylilc acids, in an amount of 10 to 400% by weight, calculated hydrate-free and in relation to peroxycarboxylic acid added. Preferred bleaching agent suspensions contain 10–30% by weight diperoxydodecanedioic acid, 5–20% by weight sodium sulfate and 2 to 6% by weight pyrogenic silicic acid, each in relation to the suspension. The use of non-dried, hydrophilized and optionally in situ-desensitized peroxycarboxylic acids is especially preferred.

The preparation of the bleaching agents is performed by homogeneously suspending the peroxycarboxylic acid in the thickened carrier liquid. The storage-resistant bleaching agent suspensions find application as laundry bleaching agents and for the preparation of cleaning and disinfecting agents.

20 Claims, No Drawings

AQUEOUS BLEACHING AGENT SUSPENSIONS CONTAINING PEROXYCARBOXYLIC ACID, METHOD FOR THEIR PREPARATION AND USE

The present invention relates to storage-resistant, pourable-to-pasty, aqueous bleaching agent suspensions. The suspensions contain a substantially water-insoluble peroxycarboxylic acid, preferably a diperoxydicarboxylic acid with 8 to 18 carbon atoms, hydrophilized in the presence of a strong acid and in a carrier liquid thickened with a colloidal silicic acid. The invention also relates to a reliable method for preparing such bleaching agent suspensions as well as to their use for purposes of bleaching and disinfection.

BACKGROUND OF THE INVENTION

Aqueous bleaching agent suspensions containing peroxycarboxylic acids are known from British Pat. No. 1,535,804, corresponding to U.S. Pat. No. 3,996,152 and U.S. Pat. No. 4,017,412. Such bleaching agent compounds can be added with advantage to alkaline washing mixtures in washing machines or be used as bleaching agents.

The use of bleaching agent suspensions, in comparison to solid, generally particulate bleaching agent compounds, has the advantage of being able to eliminate expensive and, in the case of peroxycarboxylic acids, drying and granulating steps which may not be reliable. However, in addition to being effective in use, bleaching agent suspensions must satisfy certain essential conditions which are needed for smooth and reliable handling in commercial and domestic areas. These conditions include good chemical stability and especially physical stability as regards a solid liquid phase separation and handling safety even in the case of leakage or spaying of the suspensions from barrels.

The aqueous bleaching agent compounds according to British Pat. No. 1,535,804 contain essentially water-insoluble peroxycarboxylic acids which are suspended in an aqueous carrier liquid containing a thickening agent. These compounds are thickened until gelled and their viscosity is 200 to 100,000 centipoises. Starches, cellulose derivatives, natural rubbers, synthetic organic polymers as well as inorganic thickening agents of the group of colloidal silicic acids and hydrophilic clays are claimed as thickening agents.

A major disadvantage of the known bleaching agent compounds of British Pat. No. 1,535,804 is their usually completely insufficient storage resistance, as least to the extent that they are not gelled systems. The suspensions are physically unstable since the solid phase separates from the liquid phase. This instability usually becomes noticeable directly after preparation of the suspension, frequently within one day or even hours. On the other hand, experts in this field call for a greater storage resistance, preferably one of several weeks.

Another disadvantage caused by the physical instability concerns the redispersibility of the thickened phase containing the peroxycarboxylic acid, which is unacceptably difficult. Finally, bleaching agent suspensions prepared with a low concentration of a thickening agent present an increased potential for danger because, after a suspension has been spilled, and especially after the spilled material has dried substantially non-desensitized peroxycarboxylic acid remains.

There has been no lack of attempts to create bleaching agent suspensions with improved storage resistance and a lesser potential for danger. Thus, published European patent application EP-A No. 0,160,342 teaches aqueous bleaching agent suspensions in which water-insoluble peroxy acids are suspended in an aqueous liquid containing a surfactant and an electrolyte. The limited chemical stability of these surfactant-structured suspensions was able to be improved according to the teaching of published European patent applications EP-A No. 0,176,124 and EP-A No. 0,201,958; nevertheless, they do not satisfy the requirements of physical stability placed on them.

British Pat. No. 1,535,804 disclosed the use of colloidal silicic acids, especially pyrogenic silicic acids. In order to obtain the desired thickening, however, a supplemental amount of 10 to 50% by weight, in relation to the suspension, is required. However, such a high added amount of high-grade, generally very expensive pyrogenic silicic acids is extremely uneconomical, so that there is still a need for improved bleaching agnet suspensions.

SUMMARY OF THE INVENTION

The object of the present invention is to provide pourable-to-pasty bleaching agent suspensions which have a storage resistance better than that of known suspensions. More specifically, the object is to provide systems which exhibit practically no solid-liquid phase separation and only a slight loss of available oxygen, even after a storage of two weeks. Another object is to reduce the cost of the compound as well as to provide an industrially simple method of preparation which can be managed safely.

It was surprisingly found that storage-resistant bleaching agent suspensions with a lesser added amount of thickening, colloidal silicic acids are obtained if the suspensions contain a hydrate-forming neutral salt.

Thus, the basic object of the invention is achieved by means of a pourable to pasty, aqueous bleaching agent suspension with a pH between approximately 1 and approximately 6 which contains an aqueous carrier liquid, a particulate, practically water-insoluble peroxycarboxylic acid, an acidifying agent and a colloidal silicic acid with a thickening action, which is characterized in that it contains 0.1 to 9% by weight silicic acid in relation to the bleaching agent suspension and a hydrate-forming neutral salt which desensitizes peroxycarboxylic acids in an amount of 10 to 400% by weight calculated hydrate-free and in relation to peroxycarboxylic acid added.

The bleaching agent suspensions can be both pourable as well as pasty. The viscosity usually rises with an increasing concentration of thickening agent and with an increasing amount of suspended peroxycarboxylic acid. Shearing forces such as those which occur during pouring and those which occur during a manual pressing out of a tube are sufficient in order to render the suspensions flowable. Preferred bleaching agent suspensions exhibit a structurally viscous and thixotropic behavior; their liquid point can be in a range of approximately 0.1 to 15 Pa, the viscosity, measured at 20° C. in a rotational viscosimeter at a shearing speed of 50/s, at approximately 20 to 2000 mPa.s.

Bleaching agent suspensions in accordance with the invention have good storage resistance and exhibit practically no signs of a phase separation even after two weeks of storage. A slight phase separation which occurs in the course of several weeks in rare instances is not disadvantageous because the suspension can be readily rehomogenized e.g. by means of a slight agitation. Good chemical stability is present if the available oxygen loss after four to six weeks of storage at room temperature is under 5% in relation to the available oxygen content determined after preparation of the suspension.

The carrier liquid for the practically water-insoluble peroxycarboxylic acids consists of 90–100% by weight water and 0–10% by weight of an organic solvent, each in relation to the carrier liquid. Water-soluble organic solvents, e.g. lower alcohols, can be used provided that the peroxycarboxylic acids are practically not dissolved in the carrier liquid. Water is preferred as carrier liquid.

The bleaching agent suspensions of the invention contain one or more particulate peroxycarboxylic acids which are practically water-insoluble, which signifies a solubility of under 1 g per 100 ml water. Solid peroxycarboxylic acids which exhibit a melting or breakdown point above 40° C. are suitable. The grain size of the peroxycarboxylic acids can be in a range of 1 to 500 μm, preferably 4 to 100 μm. A close distribution of grain size is generally preferred, especially in slightly thickened systems. A close distribution of grain size is also usually advantageous for use.

Water-insoluble, aliphatic or aromatic peroxycarboxylic acids with one, two or, if necessary, three peroxycarboxylic acid groups can be used. The peroxycarboxylic acids can also contain a sulfonic acid group. Aliphatic peroxycarboxylic acids with 6 to 18 carbon atoms and aromatic peroxycarboxylic acids with 7 to 14 carbon atoms are suitable. Preferred acids include aliphatic diperoxydicarboxylic acids which contain 8 to 18 carbon atoms, e.g. diperoxyazelaic acid, diperoxydodecanedioic acid, diperoxysuccinic acid substituted in the 2-position with an alkyl group containing 4 to 12 carbon atoms or diperoxyglutaric acid substituted in the 2-position with an alkyl group containing 6 to 12 carbon atoms as well as diperoxyphthalic acids and diperoxynaphthalene dicarboxylic acids. Diperoxydodecanedioic acid is especially preferred. The bleaching agent suspensions can contain one, two or more peroxycarboxylic acids, but they preferably contain one peroxycarboxylic acid.

The bleaching agent suspensions contain 1–40% by weight, preferably 5–30% by weight and quite particularly 15–30% by weight peroxycarboxylic acid in relation to the bleaching agent suspension.

The bleaching agent suspensions of the invention contain thickening, colloidal silicic acids in an amount of 0.1 to 9% by weight in relation to the suspension. The silicic acids are hydrophilic and impart both a higher viscosity as well as a thixotropic flow behavior to the carrier liquids. Pyrogenic silicic acids with a specific BET surface of approximately 50–400 $m^2/g$ and a particle size in a range of approximately 5 to 50 μm are especially suitable. The term pyrogenic silicic acids denotes those which are prepared by means of flame hydrolysis from silicon compounds such as e.g. silicon tetrachloride and are hydrophilic. Basically, silicic acids prepared by means of precipitation methods with a BET surface of 100 to 700 $m^2/g$ and a particle size of approximately 20 μm can also be used. An skilled person can test these silicic acids for their suitability by preparing test suspensions.

Thickening is preferably performed with 0.5 to 7, especially 1 to 7% by weight, in relation to the suspension, of a pyrogenic silicic acid.

It could not have been foreseen that silicic acids in the presence of a hydrate-forming neutral salt which desensitizes peroxycarboxylic acids impart an improved storage resistance to aqueous bleaching agent suspensions. In addition, the presence of a generally economical, hydrate-forming neutral salt in the suspension makes it possible to reduce the amount of generally expensive silicic acid. Also, the handling safety, e.g. in case the suspension dries out, is increased if the suspension contains a hydrate-forming neutral salt in such an amount that the peroxycarboxylic acids are sufficiently desensitized. The suspensions of the invention contain 1 to 40% by weight, preferably 2–20% by weight, in relation to the suspension, of hydrate-forming neutral salt, whereby the amount is calculated as hydrate-free salt. In relation to the peroxycarboxylic acid, the amount of neutral salt, calculated as hydrate-free salt, is generally 10 to 400% by weight, preferably 20 to 100% by weight. Less that 10% by weight in relation to peracid is possible; however, this is not recommended in view of the reduced handling safety of the suspension then and the diminution of the effect of the invention, namely, the increase of the storage resistance due to the presence of a silicic acid and a hydrate-forming neutral salt which desensitizes peroxycarboxylic acids. The neutral salt is present in the bleaching agent suspension in a partially or completely dissolved form. Preferred bleaching agent suspensions contain at a customary storage temperature of approximately 20° C. a part of the neutral salt, optionally as a hydrate thereof, in undissolved form.

Advantageous hydrate-forming neutral salts are those of alkali metals, of magnesium or of aluminum with sulfuric acid, pyrosulfuric acid, phosphoric acid, pyrophosphoric acid or tripolyphosphoric acid. Alkali metal sulfates, particularly sodium sulfate are especially preferable. Various hydrate-forming neutral salts can also be present at the same time.

The pH of the bleaching agent suspensions of the invention is between approximately 1 and approximately 6 and preferably between 2 and 5. The chemical stability of the peroxycarboxylic acids decreases at pH'es around or above 6. The acidifying agent necessary for adjusting the pH can be a mineral acid compatible with peroxycarboxylic acids such as sulfuric acid or phosphoric acid, a strongly acidic salt such as sodium hydrogen sulfate or sodium dihydrogen phosphate or an organic acid such as methane sulfonic acid, citric acid or tartaric acid. Sulfuric acid and/or alkali metal hydrogen sulfate are especially preferable.

It was surprisingly found that the storage resistance of bleaching agent suspensions of the invention is especially good if they contain hydrophilized peroxycarboxylic acid in the presence of a strong acid. The wettability of the not very hydrophilic, water-insoluble peroxycarboxylic acids by the aqueous carrier liquid is obviously improved by the fact that the peroxycarboxylic acid comes in direct contact with a strong acid, preferably sulfuric acid, during or after its preparation. Such hydrophilized peroxycarboxylic acids are obtainable e.g. from the base carboxylic acid or its anhydride and hydrogen peroxide in the presence of sulfuric acid according to a method described in U.S. Pat. No. 4,244,844 and German Patent Specification DE-OS No. 3,320,497 and DE-OS No. 3,438,529 or in the form of the in situ-desensitized products described in U.S. Pat. No. 4,287,135, German Patent Specification DE-OS No. 3,220,496 and European patent application EP-B No. 0,045,290. The acidifying agent present in the bleaching agent suspension can stem entirely or partially from the hydrophilizing and/or in situ-desensitizing of the peroxycarboxylic acid, the hydrate-forming neutral salt entirely or partially from the desensitizing.

It was further found unexpectedly that a hydrophilized peroxycarboxylic acid which is moist, that is not dried after its preparation, imparts a greater physical stability to the bleaching agent suspensions which contain it than a dried hydrophilized peroxycarboxylic acid does. Obviously, the surface structure of hydrophilized peroxycarboxylic acids is changed in an unfavorable manner by drying. The use of non-dried, optionally in situ-desensitized, hydrophilized peroxycarboxylic acids in the preparation of the bleaching agent suspensions of the invention is especially desirable because an industrially expensive drying of the peroxycarboxylic acid, which is potentially difficult as regards safety, is eliminated and suspensions with better storage resistance are obtained.

According to a preferred embodiment, the suspensions contain 10–30% by weight diperoxydodecanedioic acid, 5–20% by weight sodium sulfate (calculated as $Na_2SO_4$) and 0.5 to 7, preferably 2 to 6% by weight pyrogenic silicic acid, each in relation to the bleaching agent suspensions, and sulfuric acid and/or sodium hydrogen sulfate as acidifying agent.

The best storage resistance of these suspensions is obtained by using a non-dried diperoxydocecanedioic acid hydrophilized during preparation by means of sulfuric acid and subsequently desensitized by means of the addition of sodium hydroxide under formation of sodium sulfate.

In addition to the constituents of the bleaching agent suspensions of the invention discussed above, the latter can contain other substances compatible with them in order to optimally adapt the bleaching agent suspensions to the particular application intended. In general, the amounts to be added for this purpose are small in relation to the amounts of the peroxycarboxylic acid and the neutral salt. Typical additives are:

Neutral desensitizing means other than hydrate-forming ones, e.g. acidic desensitizing substances such as hydrogen phosphates, dihydrogen phosphates, boric acid or silicic acid.

Chelate complexing agents for complexing metal ions with a decomposing action and for improving therewith the chemical stability of the suspended peroxycarboxylic acids. Examples of such complexing agents are ethylene diamine tetraacetic acid, diethylene triamine pentaacetic acid, preferably 2-hydroxyethylidene diphosphonic acid, ethylene diamine tetra(methylene phosphonic acid) or diethylene triamine penta(methylene phosphoric acid).

Stabilizers such as dipicolinic acid or trialkyl phosphane oxides.

Anionic and/or non-ionic surfactants, e.g. alkyl benzene sulfonates, alkyl ether sulfates, alkyl sulfonates, ethoxylates and/or propoxylates of fatty alcohols, alkyl phenols, fatty acids or perfuming agents, optical brighteners, antioxidants.

The surfactants and additional desensitizing agents can be present in amounts up to 20% by weight, the other additives generally under 1% by weight, each in relation to the suspension. An expert can form a picture by means of orienting storage tests whether, and to what extent, he can add the intended additives to the suspensions of the invention without adversely affecting their chemical and physical stability.

As has already been stated, the bleaching agent suspensions of the invention are physically and chemically storage-resistant for several weeks and thus permit safe handling during storage, transport and use. Phase separation, floating or settling of the solid or inhomogeneities within the suspension, such as those which occur in previously known bleaching agent suspensions after only a brief storage time, do not appear in the suspensions of the invention or are observed only in rare instances after several weeks and can be easily reversed. As a result of the presence of the hydrate-forming desensitizing agent, a dried bleaching agent suspension also remains safe.

The bleaching agent suspensions of the invention are prepared by means of homogeneously suspending a water-insoluble peroxycarboxylic acid in an aqueous carrier liquid containing a thickening, colloidal silicic acid, a hydrate-forming neutral salt which desensitizes peroxycarboxylic acids and containing an acidifying agent. The individual components of the suspension are added in the previously mentioned amounts into the carrier liquid. The neutral salt and acidifying agent are added before, after, or preferably together with the addition of the peracid. The mixture is homogeneously suspended and the pH is adjusted to 1 to 6. It is preferable to first suspend the colloidal silicic acid in the carrier liquid and then add the other essential and optionally components to the bleaching agent suspension and to homogenize the mixture using shearing forces, e.g. by means of intensive stirring or shaking. A propeller agitator with a stirring speed of approximately 1,000–2,000 rpms and a stirring time between 5 and 20 minutes are generally suitable for homogenization.

According to a preferred embodiment, a peroxycarboxylic acid hydrophilized in the presence of a strong acid and optionally also desensitized is suspended in the thickened carrier liquid. In this embodiment, the desensitizing agent is a hydrate-forming neutral salt and the acidifying agent is derived from the hydrophilizing and/or desensitizing stage. It is especially advantageous to add a non-dried hydrophilized peroxycarboxylic acid with acidifying agent stemming from its preparation and with associated moisture and a hydrate-forming neutral salt present which optionally is derived from the desensitizing. The last-named preferred embodiments are distinguished by the easy wettability of the per compound, the increased storage resistance of the resulting bleaching agent suspension and above all by the simple and safe preparation of the suspension—simple because a peroxycarboxylic acid containing an acidifying agent and neutral salt is added into the thickened carrier liquid and safe because the peroxycarboxylic acid is not sensitized at any time, nor does it have to be dried at any time.

The bleaching agent suspensions of the invention can be added as a washing bleach in combination with detergents and/or washing agents. Tea spots, coffee spots and other spots are removed from textiles e.g. during washing at 20° to 60° C. if a bleaching agent suspension of the invention is added to an alkaline washing liquid containing customary washing agent components, especially wash-active surfactants, inorganic polyphosphate builders and/or zeolite builders, organic chelating agents, sodium silicate, alkalis and sodium sulfate. The bleaching agent suspension is added in such an amount to the washing liquid that the available oxygen which can be released from the peroxycarboxylic acid amounts to 1 to 100 ppm. The washing agent components are distributed in a dissolved and even manner in a concentration in the washing liquid which is customarily effective for washing.

The bleaching agent suspensions can also be used as bleach boosters and for preparing cleaning agents and disinfecting agents.

The following examples clarify the invention.

Preparation of the Bleaching Agent Suspension

The carrier liquid, water in the examples, is placed in a 250 ml beaker glass equipped with a three-blade propeller agitator. After addition of the thickening agent under stirring, the peroxycarboxylic acid and the other components are added and homogeneously suspended by intensive stirring. The diperoxydodecanedioic acids (DPDDA) added were prepared, to the extent not indicated otherwise, according to DE-OS No. 3,320,497 (hydrophilized DPDDA) or DE-OS No. 3,320,496 (desensitized hydrophilized DPDDA); as a result of acid associated with them, the pH of the suspensions was approximately 3.5 to 4.

In order to test physical stability, the suspension is transferred into a graduated 100 ml cylinder and stored at room temperature. Instabilities during storage can be noticed as a phase containing little or no solid material, (this phase can occur "at the top", "at the bottom" or as a "gap" within the 100 ml layer). The chemical stability is determined by iodometric or potentiometric titration; the latter permits the detection of both the peroxycarboxylic acid and the carboxylic acid which forms its base and is produced during the breakdown of the peracid.

EXAMPLE 1

25% by weight DPDDA suspensions according to the following table are prepared in a customary manner by a 10-minute suspension at 1700 rpms and tested for their storage resistance in a 100 ml graduated cylinder. Suspensions A and B contain no thickening agent—the peroxycarboxylic acids added have a thickening action but differing amounts of sodium sulfate derived from the desensitizing; the stabilizing action of the neutral salt is clear. Suspension C, corresponding to British Pat. No. 1,535,804, contains 1.5% by weight of the pyrogenic silicic acid Aerosil ®200 (Degussa AG, Frankfurt on the Main) as thickening agent but no hydrate-forming neutral salt with a desensitizing action. Suspension D is according to the present invention and is clearly superior to suspension C.

| Physical stability after | Suspension A without thickening agent DPDDA 87/9 | B without thickening agent DPDDA 64/32 | C with Aerosil ® 200 DPDDA 92/0 | D with Aerosil ® 200 DPDDA 64/32 |
|---|---|---|---|---|
| 1 hr. | 6 ml/bottom | stable | stable | stable |
| 2 hrs. | 8 ml/bottom | 1 ml/bottom | stable | stable |
| 5 hrs. | 8 ml/bottom | 1 ml/bottom | stable | stable |
| 24 hrs. | 9 ml/bottom | 8 ml/bottom | stable | stable |

(*) The numbers after the slash signify the $Na_2SO_4$ content, the numbers in front of it the DPDDA content in the dried, hydrophilized peroxycarboxylic acid added. Sufficient acidifying agent was associated with DPDDA 64/32 and DPDDA 87/9;in suspension C with DPDDA 92/0, pH 3.6 was adjusted by the addition of $H_2SO_4$.

EXAMPLE 2

In accordance with the general procedure, nondried, hydrophilized diperoxydodecanedioic acid desensitized in situ with $Na_2SO_4$ and with a content of 61.9% by weight DPDDA and approximately 24.3% by weight $Na_2SO_4$ is suspended (10 minutes at 2,000 rpms) in water thickened with 1.0, 2.5 or 5.0% by weight, of pyrogenic silicic acid (Aerosil ®200, Degussa, AG, Frankfurt on the Main) in relation to the suspension. The DPDDA content in the suspension is 25% by weight. The behavior of the suspensions during storage at room temperature is shown in the following table:

| | Suspensions A | B | C |
|---|---|---|---|
| Pyrogenic silicic acid (% by weight) | 1% | 2.5% | 5.0% |
| Physical stability | | | |
| after 1 day | stable | stable | stable |
| after 4 days | 4 ml/above | 2 ml above | stable |
| after 11 days | 7 ml/above | 2 ml/above | stable |
| after 18 days | 10 ml/above | 3 ml/above | stable |
| after 32 days | 13 ml/above | 2 ml/above | stable |

Suspension A is not sufficiently storage-resistant whereas suspension B sediments slightly in the first days but is then stable. The DPDDA content of the very storage-resistant suspension C did not change significantly during the 32-day storage.

EXAMPLE 3

25% by weight DPDDA suspensions are prepared in the standard manner in a 2-liter beaker glass from the additives listed below. However, the suspensions are suspended with a crescent-shaped agitator for 15 minutes at 1300 rpms. Non-dried or dried, hydrophilized diperoxydodecanedioic acid desensitized in situ with $Na_2SO_4$ is added and the suspensions stored at room temperature. The results are given in the following table:

| | Suspensions A | B |
|---|---|---|
| "Dried DPDDA" with 70% by wt. DPDDA and 26% by wt. $Na_2SO_4$ | 429 g | — |
| "non-dried DPDDA" with 61% by wt. DPDDA and 22.5% by wt. $Na_2SO_4$ | — | 492 g |
| Pyrogenic silicic acid (Aerosil ® 200, Degussa AG) | 60 g | 60 g |
| Turpinal SL (Henkel KGaA) (= 60% hydroxyethylidine diphopho acid) | 10 g | 10 g |
| Water | 701 g | 638 g |
| pH of the suspension | 3.8 | 3.6 |
| Physical stability | | |
| after 1 week | 4 mm/above | stable |
| after 2 weeks | 4 mm/above | stable |
| after 4 weeks | 6 mm/above | stable |
| after 6 weeks | 10 mm/above | stable |

Suspension A sedimented slowly and showed a concentration gradient within the depth of bed (120 mm altogether) after 4 weeks.

Suspension B was completely stable and no inhomogeneity could be detected within the depth of bed even after 8 weeks of storage.

Suspension B exhibited a liquid limit of approximately 2 Pa, a light, structurally viscous and hardly thixotropic behavior; the viscosity was 380 mPa.s at a shearing speed of 10/s or 180 mPa.s at 50/s (measured in a Rotovisko RV3 rotational viscosimeter of the Haake company).

EXAMPLE 4

A suspension containing 2.5% by weight pyrogenic silicic acid (Aerosil®200), 9.3% by weight sodium sulfate and 25% by weight DPDDA, each in relation to the suspension, was prepared from hydrophilized DPDDA with a content of 95% DPDDA, approximately 4% dodecanedioic acid and 1% residual moisture and the pH of 4.5 was adjusted by adding sulfuric acid.

The carrier liquid was water. Water-free sodium sulfate was stirred into the suspension after the peracid.

After 1 week of storage in a 100 ml measuring cylinder, 1 ml and after 2 weeks of storage 2 ml of an almost clear phase separated "at the top".

What is claimed is:

1. A storage-resistant, pourable-to-pasty, aqueous bleaching agent suspension having a pH between approximately 1 and approximately 6, containing an aqueous carrier liquid, a particulate, substantially water-insoluble peroxycarboxylic acid, an acidifying agent, a thickening, colloidal silicic acid, the amount of silicic acid being 0.1 to about 7% by weight in relation to the bleaching agent suspension, and contains a hydrateforming neutral salt which desensitizes peroxycarboxylic acids in an amount of 10 to 400% by weight, calculated hydrate-free in relation to the peroxycarboxylic acid used.

2. A bleaching agent suspension according to claim 1 which contains 0.5 to 7% by weight pyrogenic silicic acid in relation to the suspension and in which the carrier liquid consists of 90–100% by weight and 0–10% by weight of an organic solvent in relation to the carrier liquid.

3. A bleaching agent suspension according to one of claims 1 and 2 which contains a peroxycarboxylic acid hydrophilized in the presence of a strong acid.

4. A bleaching agent suspension as set forth in claim 3 in which the peroxycarboxylic acid is obtainable during the preparation of peroxycarboxylic acid from the base carboxylic acid or its anhydride and hydrogen peroxide in the presence of sulfuric acid.

5. A bleaching agent suspension as set forth in claim 1 or claim 2 which contains 1 to 40% by weight peroxycarboxylic acid in relation to the suspension.

6. A bleaching agent suspension as set forth in claim 5 in which the amount of peroxycarboxylic acid is 5 to 30%.

7. A bleaching agent suspension as set forth in any one of claims 1 and 2 which contains a hydrate-forming neutral salt of a metal selected from the group consisting of alkali metals, magnesium and aluminum with an acid selected from the group consisting of sulfuric acid, pyrosulfuric acid, phosphoric acid, pyrophosphoric acid and tripolyphosphoric acid.

8. A bleaching agent suspension according to one of claims 1 and 2 which contains an aliphatic or aromatic diperoxydicarboxylic acid with 8 to 14 carbon atoms.

9. A bleaching agent suspension according to one of claims 1 and 2 which contains sulfuric acid and/or an alkali metal hydrogen sulfate as acidifying agent and an alkali metal sulfate as hydrateforming neutral salt.

10. A bleaching agent suspension according to one of claims 1 and 2 which additionally contains other neutral or acidic desensitizing agents and/or chelating agents and/or stabilizers and/or anionic and/or nonionic surfactants.

11. A bleaching agent suspension as set forth in claim 10 in which the desensitizing agent is boric acid.

12. A bleaching agent suspension as set forth in claim 10 in which the chelating agent is selected from the group consisting of N-methylene phosphonate-substituted alkylene polyamines.

13. A bleaching agent suspension as set forth in claim 10 in which the stabilizer is dipicolinic acid or a trialkyl phosphane oxide.

14. A bleaching agent suspension as set forth in claim 1 or claim 2 which contains 10 to 30% by weight diperoxydodecanedioic acid, 5 to 20% by weight sodium sulfate and 0.5–7% by weight pyrogenic silicic acid, each in relation to the bleaching agent suspension, and sulfuric acid and/or sodium hydrogen sulfate as acidifying agent.

15. A bleaching agent suspension as set forth in claim 14 in which the amount of pyrogenic silicic acid is 2–6%.

16. A method for preparing a bleaching agent suspension according to claim 1 or claim 2 which comprises homogeneously suspending a particulate, substantially water-insoluble peroxycarboxylic acid in an aqueous carrier liquid containing a thickening, colloidal silicic acid, an acidifying agent and additives, the amount of colloidal silicic acid being 0.1 to about 7% in relation to the bleaching agent suspension, and before, during or after the addition of the peroxycarboxylic acid to the carrier liquid, adding 10 to 400% by weight, calculated hydrate-free and in relation to the peroxycarboxylic acid, of a neutral salt to the latter.

17. A method as set forth in claim 16 in which a peroxycarboxylic acid is added which was hydrophilized in the presence of a strong acid and optionally desensitized.

18. A method as set forth in claim 17 in which the hydrophilized peroxycarboxylic acid is added with associated acidifying agent derived from its preparation and with associated moisture.

19. A method as set forth in claim 18 in which the hydrophilized peroxycarboxylic acid is added with hydrateforming neutral salt derived from the desensitizing.

20. A bleaching agent comprising the bleaching agent suspension according to claim 1 or claim 2 in combination with a washing agent.

* * * * *